US006619825B2

(12) United States Patent
Natsume

(10) Patent No.: US 6,619,825 B2
(45) Date of Patent: Sep. 16, 2003

(54) VEHICLE LAMP

(75) Inventor: Kazunori Natsume, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 09/953,878

(22) Filed: Sep. 18, 2001

(65) Prior Publication Data

US 2002/0034078 A1 Mar. 21, 2002

(30) Foreign Application Priority Data

Sep. 18, 2000 (JP) ..... P. 2000-281900

(51) Int. Cl.[7] ..... F21V 1/00

(52) U.S. Cl. ..... 362/509; 362/517; 362/326; 362/328; 362/545; 362/521; 362/518; 359/839

(58) Field of Search ..... 362/509, 517, 362/326, 328, 545, 540, 521, 518, 494; 359/839

(56) References Cited

U.S. PATENT DOCUMENTS 4,733,335 A * 3/1988 Serizawa et al. ..... 362/80
4,906,085 A * 3/1990 Sugihara et al. ..... 350/601
5,207,492 A * 5/1993 Roberts ..... 362/30
5,249,104 A * 9/1993 Mizobe ..... 362/31
5,455,747 A * 10/1995 Aoyama ..... 362/61
5,490,049 A * 2/1996 Montalan et al. ..... 362/240
5,580,156 A 12/1996 Suzuki et al. ..... 362/184
5,603,561 A 2/1997 Ohishi ..... 362/80
5,746,497 A 5/1998 Machida ..... 362/80
5,788,357 A * 8/1998 Muth et al. ..... 362/83.1
6,005,724 A * 12/1999 Todd ..... 359/884
6,019,492 A 2/2000 Ikegaya et al. ..... 362/521
6,296,382 B1 * 10/2001 Hamelbeck ..... 362/544
6,332,701 B1 * 12/2001 Yamada et al. ..... 362/517

FOREIGN PATENT DOCUMENTS

JP 2-22505 2/1990 ..... F21Q/1/00

* cited by examiner

*Primary Examiner*—Sandra O'Shea
*Assistant Examiner*—Jacob Y. Choi
(74) *Attorney, Agent, or Firm*—Sughrue Mion, PLLC

(57) ABSTRACT

A lamp unit having a dome-shaped translucent panel disposed in front of several light sources is provided. Opening portions corresponding to certain light sources are formed crosswise in the translucent panel. A condenser lens is provided in the rear of each opening portion in the translucent panel. The dome-shaped portion of the translucent panel is formed as a half-mirror portion, whereby five small cross-shaped translucent domes are visible when the vehicle lamp is in an off state. The light sources positioned to the rear of the opening portions and the light sources positioned to the rear of the half-mirror portions provide an unexpected luminous intensity distribution.

9 Claims, 8 Drawing Sheets

VEHICLE LAMP

BACKGROUND OF THE PRESENT INVENTION

1. Technical Field of the Invention

The present invention relates to a vehicle lamp and more particularly to a structure for improving the appearance of the vehicle lamp.

2. Prior Art

A typical vehicle lamp comprises a light source, a lamp body for supporting the light source and a translucent cover mounted on the lamp body. However, conventional vehicle lamps appear changeless in the case where the vehicle lamps are on and in the case where the vehicle lamps are off.

On the other hand, the adoption of a vehicle lamp with its translucent cover (the light cover) subjected to half-mirror processing as disclosed in JP-2-22505U results in making the interior of the vehicle lamp in the on state visible. The half-mirror processing also makes the interior thereof (in the vehicle lamp off state) invisible due to the external light reflective action of the translucent cover, whereby the vehicle lamp in the on state can look quite different from what is in the off state.

As the vehicle lamp described in the publication above is arranged such that the translucent cover has been subjected only to the half-mirror processing, the vehicle lamp in the off state causes scenery ahead of the vehicle lamp to be simply reflected on the translucent cover in a whitish fashion. This is similar to the way a window with a half-mirror film stuck thereon is seen. With respect to the way the vehicle lamp looks while the vehicle lamp is in the on state, the arrangement above is also insufficient because the hidden light source looks luminous only while vehicle lamp is in the off state.

BRIEF SUMMARY OF THE INVENTION

An object of the present invention made in the foregoing circumstances is to provide a vehicle lamp that appears different by making the appearance of the vehicle lamp in an on state look great different from the appearance of the vehicle lamp in an off state.

According to the present invention, a vehicle lamp comprises a light source and a translucent panel provided in front of the light source. The translucent panel is formed with half-mirror portions subjected to half-mirror processing and non-half-mirror portions or the opening portions not subjected to half-mirror processing. The vehicle lamp comprises a plurality of light sources provided so that the light sources are positioned in the rear of the half-mirror portions and the non-half-mirror portions or the opening portions.

As long as the vehicle lamp is provided with the translucent panel in front of the light source, the arrangement of other members for use in forming the vehicle lamp is not limited to any specific arrangement.

As long as the translucent panel is provided in front of the light source, the translucent panel could be an outer panel (translucent cover) exposed forward on the vehicle lamp or an inner panel provided in the rear thereof. Further, the translucent panel may be a see-through panel or what is formed of lens elements.

The arrangement of the half-mirror portion and the non-half-mirror portion or the opening portion in the translucent panel is not limited to any specific arrangement.

Although a plurality of light sources is provided, the number of light sources provided in the rear of the half-mirror portion and the number of light sources provided in the rear of the non-half-mirror portion or the opening portion may be singular or plural. Moreover, the arrangement of the light sources is not limited to any specific arrangement but may be, for example, inclusive of incandescent bulbs, LEDs (light emitting diodes) or similar devices.

As described above, since the vehicle lamp according to the present invention is arranged so that the translucent panel is formed with the half-mirror portions subjected to half-mirror processing and the non-half-mirror portions or the opening portions not subjected to half-mirror processing and that the plurality of light sources are provided so that the light sources are positioned in the rear of the half-mirror portions and the non-half-mirror portions or the opening portions, the following operation is obtainable.

More specifically, the interior of the vehicle lamp in the rear of the half-mirror portion can be made invisible by the external light reflective action of the half-mirror portion. The interior of the vehicle lamp in the rear of the non-half-mirror portion or the opening portion can be made visible thereby while the vehicle lamp is in the off state.

Further, when both the light source positioned in the rear of the non-half-mirror portion or the opening portion and the light source positioned in the rear of the half-mirror portion are turned on, the vehicle lamp can be made to look luminous. The luminescent color is not expected from the design of the vehicle lamp in the off state. In other words, since only the non-half-mirror portion or the opening portion allows the interior of the vehicle lamp to be visible in the off state is visible, it appears that only the non-half-mirror portion or opening portion appears luminous even in the off state.

With the arrangement above, the translucent panel is dome-shaped and a condenser lens is provided between the non-half-mirror portion or the opening portion and the light source positioned in the rear of the non-half-mirror portion or the opening portion. Thus, a vehicle lamp having a design in which a small translucent dome is disposed in a dome that appears to reflect external light is achieved.

Although the light source positioned in the rear of the condenser lens appears magnified, the provision of the diffusion lens therebetween allows the light source to be hardly visible because of the diffusive action of light passing through the diffusion lens. In so doing, moreover, it is possible to make the luminosity of the whole light source in the on state look substantially uniform over a wide luminescent area.

With the arrangement above, the provision of the non-half-mirror portion or the opening portion in the central position of the translucent panel, as well as in a plurality of peripheral positions surrounding the central position) provides an enhanced lamp design for the vehicle lamp in the on state and off state both.

At this time, by disposing the light source positioned in the rear of the half-mirror portion between the light sources positioned in the rear of the non-half-mirror portion or the opening portion, the luminosity of the whole vehicle lamp can be made substantially uniform.

With the arrangement above, by forming each light source with a plurality of LEDs, the light source can be made to look luminous over a wide luminescent area and the luminescent color of each light source can be selected.

BRIEF DESCRIPTION OF THE DRAWINGS

The accompanying drawings, which are incorporated in and constitute a part of this specification, illustrate the present invention and, together with the written description, serve to explain the aspects, advantages and principles of the present invention. In the drawings.

DETAILED DESCRIPTION OF THE PRESENT INVENTION

Reference will now be made to the drawings that illustrate an embodiment for carrying out the present invention.

Figure 1:
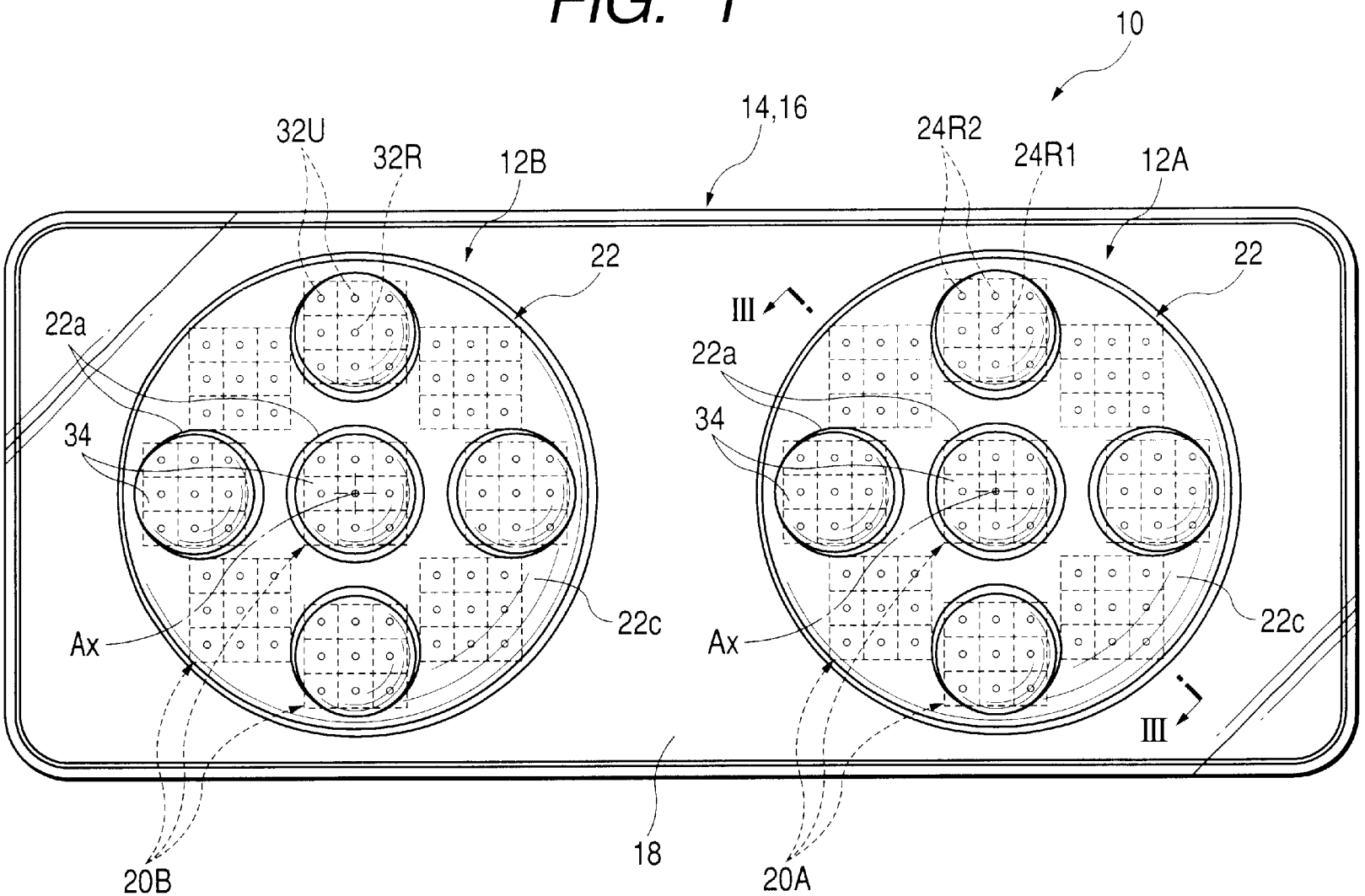
FIG. 1 is an elevation view of a vehicle lamp according to an embodiment of the present invention.
Figure 2:
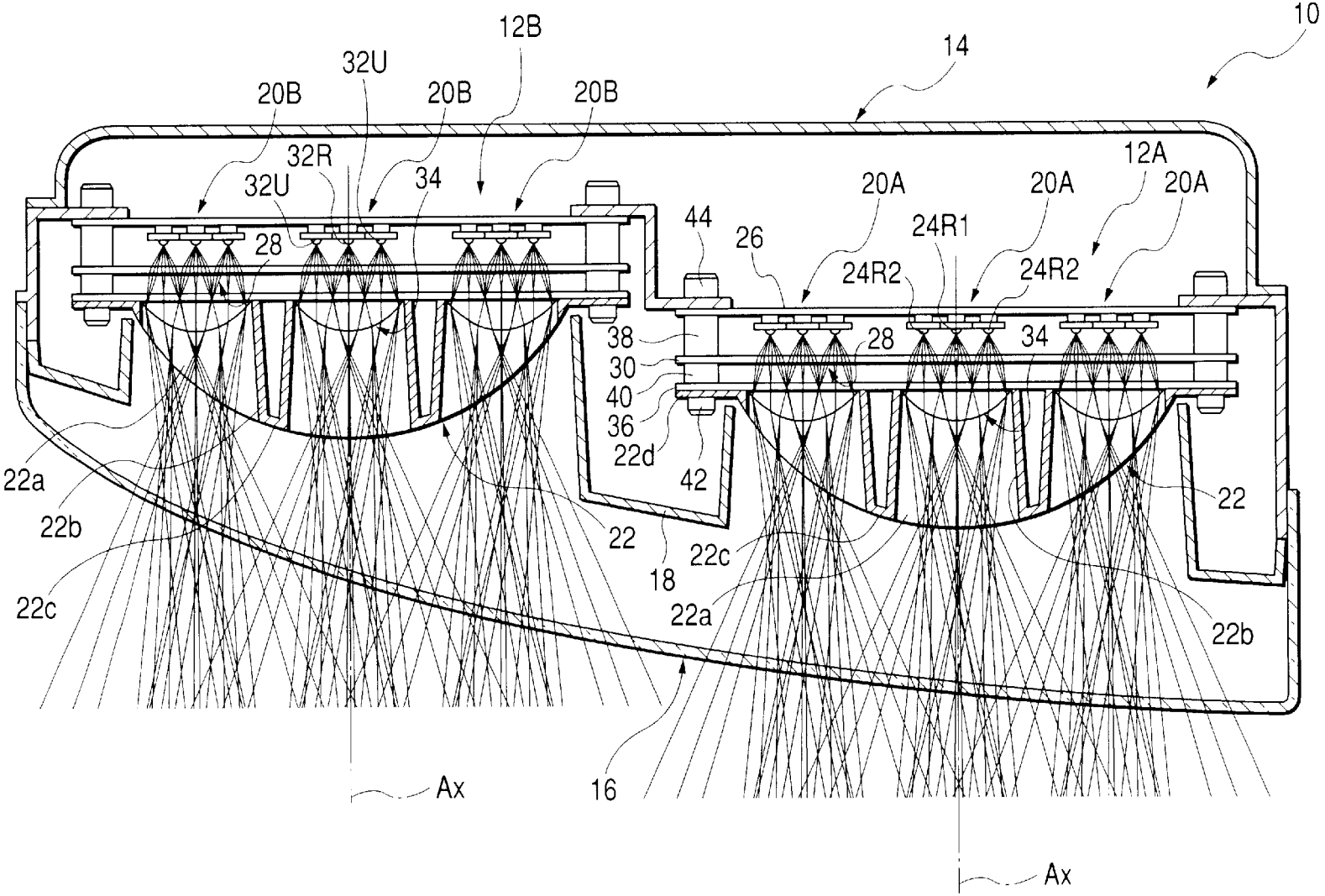
FIG. 2 is a horizontal sectional view of a vehicle lamp according to an embodiment of the present invention.
Figure 3:
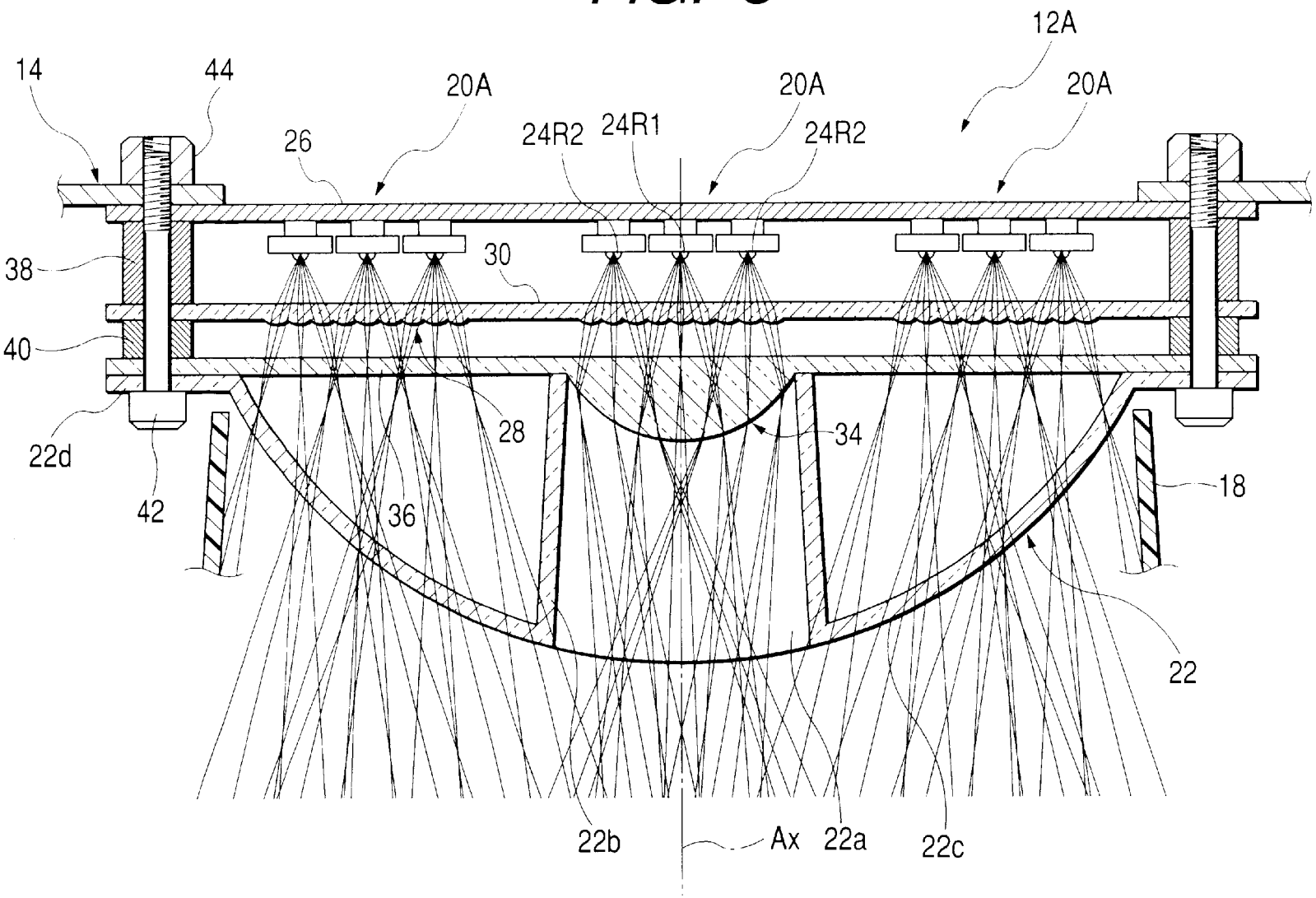
FIG. 3 is a detailed sectional view taken on line III—III of FIG. 1.

FIG. 1 is an elevation view of a vehicle lamp 10 embodying the present invention. FIG. 2 is a horizontal sectional view thereof, and FIG. 3 is a detailed sectional view taken on line III—III of FIG. 1.

As shown in these drawings, the vehicle lamp 10 according to the present invention is a rear combination lamp installed in the left-side rear end portion of a vehicle. The vehicle lamp 10 comprises a pair of lamp units 12A and 12B contained in a lamp chamber formed with a lamp body 14 having a contour that is long sideways and with a plain translucent cover 16. In addition, a shielding panel 18 surrounds these lamp units 12A and 12B.

The vehicle lamp 10 functionally serves as a tail lamp, a stop lamp and a turn-signal lamp. Specifically, the lamp unit 12A positioned on the inner side of the vehicle in the width direction thereof can be turned on in a tail lamp lighting mode and a stop lamp lighting mode. The lamp unit 12B positioned on the outer side of the vehicle in the width direction thereof can be turned on in the tail lamp lighting mode and a turn-signal lamp lighting mode.

The construction of the lamp unit 12A will be described first.

The lamp unit 12A is provided with nine light sources 20A and a translucent panel 22 provided in front of these light sources 20A (i.e., provided in front of the vehicle lamp but practically situated in the rear of the vehicle; the same will also apply to the following).

Each of the light sources 20A comprises nine red LEDs 24R1 and 24R2 that are vertically and horizontally disposed, e.g. a 3×3 square. Of the nine red LEDs 24R1 and 24R2, one red LED 24R1, as a first LED group, is disposed in the central position of the light source 20A. The red LED 24R1 is turned on in the tail lamp lighting mode. The remaining eight red LEDs 24R2, as a second LED group, surround the red LED 24R1. The eight red LEDs 24R2 are turned on together with the red LED 24R1 in the stop lamp lighting mode.

One of the nine light sources 20A is disposed on an optical axis Ax extending in a longitudinal direction and passing through the central position of the lamp unit 12A. The remaining eight light sources are disposed so as to surround the optical axis Ax at peripherally at 45° intervals on the same circumference. The nine red LEDs 24R1 and 24R2 forming each of the nine light sources 20A are mounted on a single printed board 26.

A diffusion lens 28 having a plurality of diffusion lens elements (fish-eye lenses) is provided in front of each light source 20A. These diffusion lenses 28 are formed on a single diffusion lens board 30.

Condenser lenses 34 are provided in front of the diffusion lenses 28. Specifically, the condenser lenses are provided in front of the light source 20A positioned on the optical axis Ax and in front of the four of the light sources 20A positioned in the vertical and horizontal directions of the central light source 20A (five of the cross-shaped light sources 20A). Each of these condenser lenses 34 is formed with a planoconvex lens having a convex surface on the front side and formed on a single condenser lens board 36.

The translucent panel 22 is dome-shaped and protrudes forward. In the front portion of each of the cross-shaped five light sources 20A in the translucent panel 22, a circular opening portion 22*a* slightly greater in diameter than the condenser lens 34 in the elevation view of the vehicle lamp is provided. A cylindrical portion 22*b* extending towards the condenser lens board 36 while maintaining the substantially outer peripheral configuration of the opening portion 22*a* is provided in the opening portion 22*a*. Further, the dome-shaped surface of the translucent panel 22 is subjected to half-mirror processing. The half-mirror processing provides a half mirror portion 22*c*. The surface of the cylindrical portion 22*b* in the translucent panel 22 is also subjected to the half-mirror processing.

The translucent panel 22 has an outer peripheral portion formed as an annular flat portion 22*d*. Together with the printed board 26, the diffusion lens board 30 and the condenser lens board 36 via spacers 38 and 40, the translucent panel 22 is fixed to the lamp body 14 with bolts 42 and nuts 44 in several peripheral places of the annular flat portion 22*d*.

In this lamp unit 12A, light emission is carried out as follows.

With respect to the five light sources 20A forming a cross-shape, light from the red LEDs 24R1 and 24R2 forming the light source 20A passes through the diffusion lens 28 and is diffused. The diffused light then passes through the condenser lens 34 and is concentrated before being emitted forward. With respect to the four remaining light sources 20A, light from red LEDs 24R1 and 24R2 forming each of the four light sources is passes through the diffusion lens 28 and is diffused. The diffused light then passes through the translucent panel 22 and is emitted forward. Thus, the required luminous intensity distribution of the vehicle lamp can be secured.

The construction of the lamp unit 12B will now be described.

The construction of the lamp unit 12B is basically similar to that of the lamp unit 12A but different in LEDs forming the 20B from the lamp unit 12A.

The lamp unit 12B is provided with nine light sources 20B, each of which comprises of nine LEDs such that are vertically and horizontally disposed e.g. a 3×3 square. One red LED 32R is disposed in the central position of the light source and eight amber LEDs 32U surround the red LED 32R. In each light source 20B, the one red LED 32R, as a first LED group, is turned on in the tail lamp lighting mode. Also, in each light source 20B, the eight amber LEDs 32U, as a second LED group, are turned on in the turn-signal lamp lighting mode.

FIGS. 4 to 7 are elevation views of the vehicle lamp 10, according to this embodiment of the present invention, being operated in the various lamp lighting modes.

Figure 4:
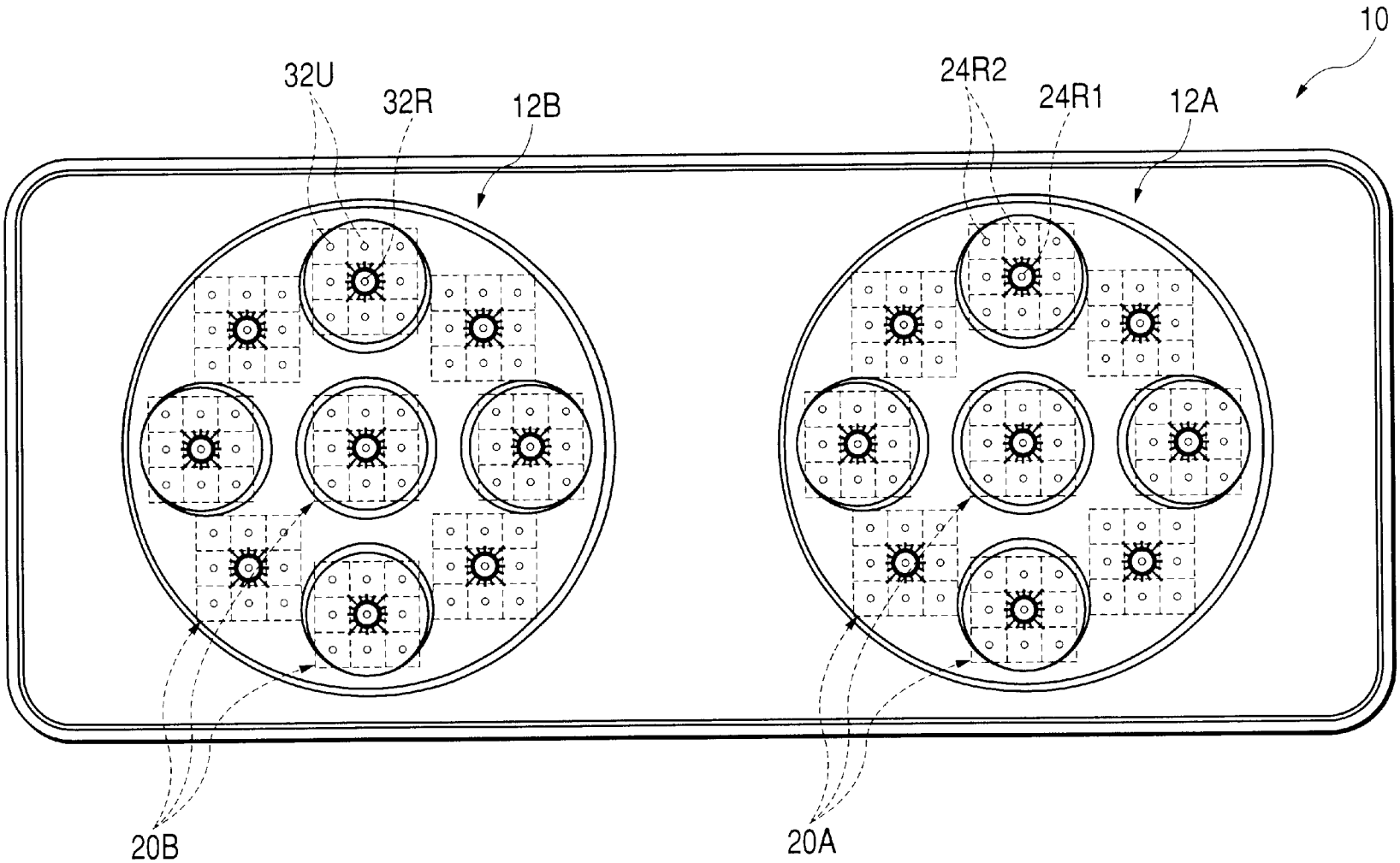
FIG. 4 is an elevation view showing a condition in which the vehicle lamp is turned on in a tail lamp lighting mode.

As shown in FIG. 4, only the red LEDs 24R1 and 32R positioned in the centers of the respective light sources 20A and 20B of both lamp units 12A and 12B are turned on in the tail lamp lighting mode. Thus, both the lamp units 12A and 12B of the vehicle lamp 10 are turned red and function as tail lamps.

Figure 5:
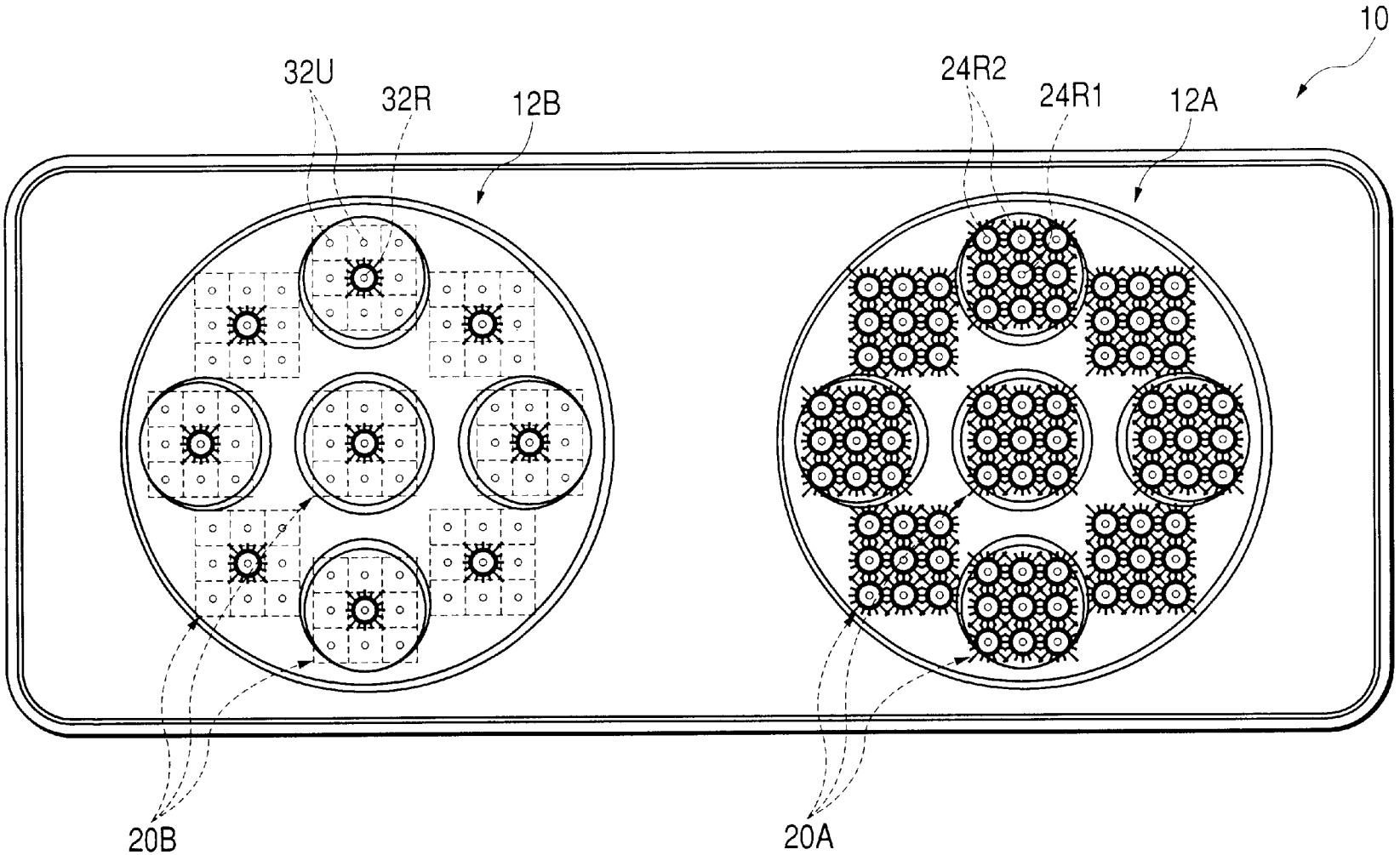
FIG. 5 is an elevation view showing a condition in which the vehicle lamp is turned on in a tail-stop lamp lighting mode.

As shown in FIG. 5, the amber LEDs 32U in each of the light sources 20B of the lamp unit 12B remain off in the tail-stop lamp lighting mode. The red LEDs 32R positioned in the center of the light source 20B of the lamp unit 12B remains turned on in the tail-stop lamp lighting mode. The eight red LEDs 24R2 positioned around the red LED 24R1, as well as the red LED 24R1, in each of the light sources 20A of the lamp unit 12A are turned on in the tail-stop lamp lighting mode. Thus, the vehicle lamp 10 fulfill the functions of both tail and stop lamps, as the lamp unit 12A is turned on in the stop lamp lighting mode while the lamp unit 12B maintains the tail lamp lighting mode.

Figure 6:
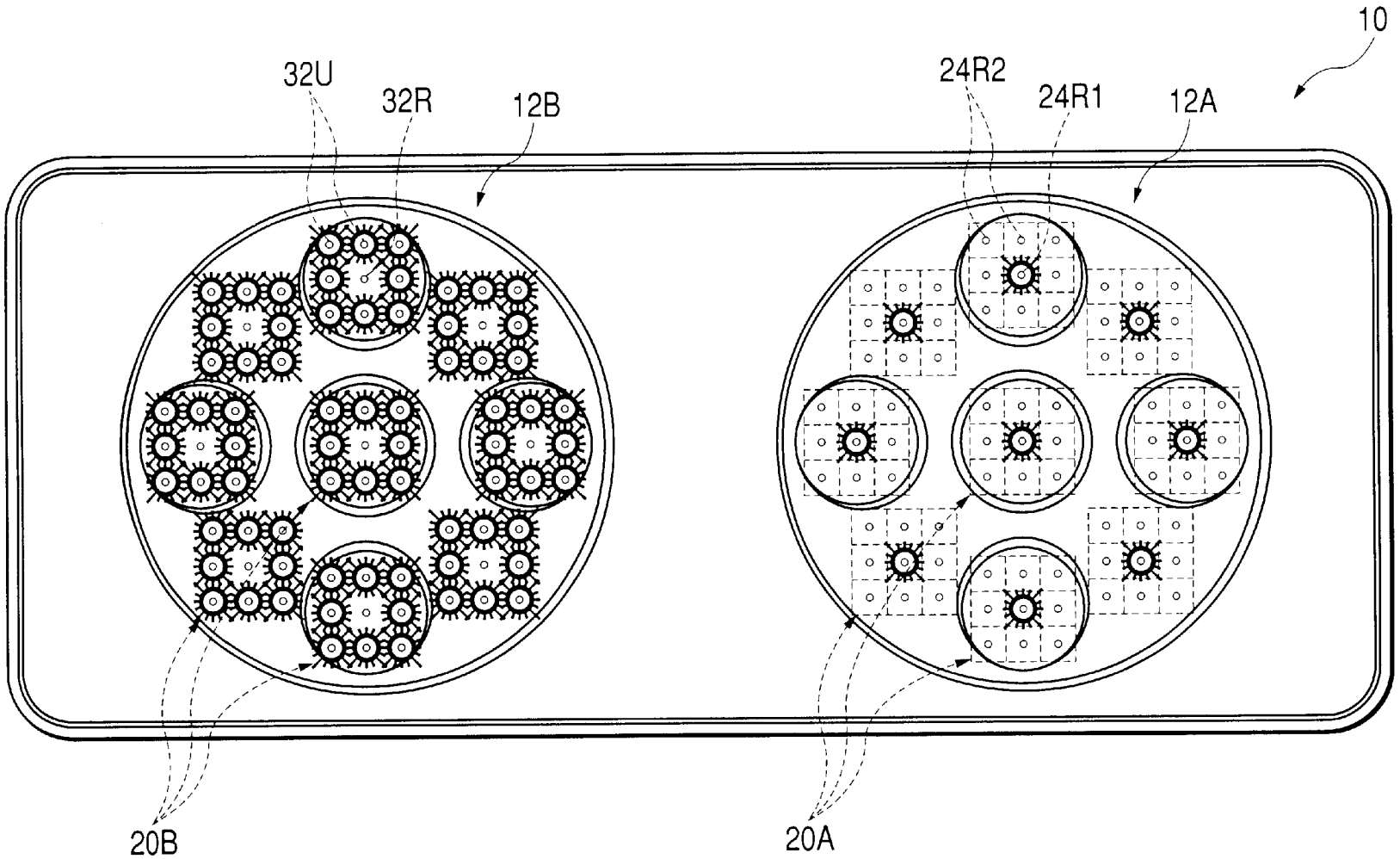
FIG. 6 is an elevation view showing a condition in which the vehicle lamp is turned on in a tail and turn-signal lamp lighting mode.

As shown in FIG. 6, the red LEDs 24R1 positioned in the center of the light sources 20A of the lamp unit 12A remain turned on in the tail and turn-signal lamp lighting mode. The red LED 32R disposed in the central position of each light source 20B of the lamp unit 12B is turned off in the turn-signal lamp lighting mode. However, the eight amber LEDs 32U positioned around the red LED 32U are intermittently turned on in the turn-signal lamp lighting mode. Thus, the vehicle lamp 10 fulfills the functions of tail and turn-signal lamps, as the lamp unit 12B is turned on in the turn-signal lamp lighting mode while the lamp unit 12A maintains the tail lamp lighting mode.

Figure 7:
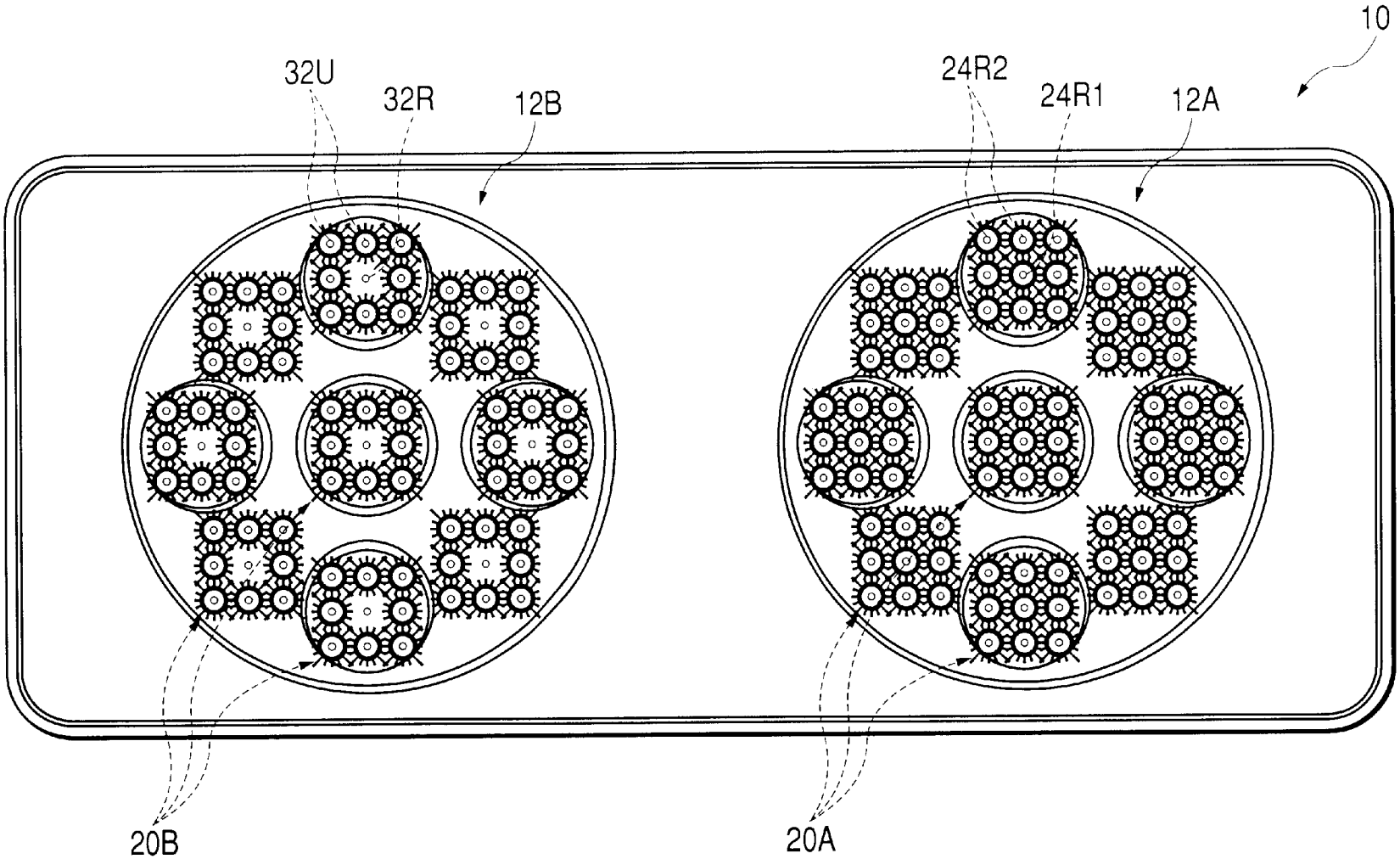
FIG. 7 is an elevation view showing a condition in which the vehicle lamp is turned on in a stop and turn-signal lamp lighting mode.

As shown in FIG. 7, the red LEDs 32R positioned in the center of the light sources 20B of the lamp unit 12B remain turned off in the stop and turn-signal lamp lighting mode, wherein the turn-signal lamp and a brake lamp are simultaneously turned on. The eight red LEDs 24R2 disposed around the red LED 24R1, as well as the red LED 24R1, in each light source 20A of the lamp unit 12A are simultaneously turned on in the stop and turn-signal lamp lighting mode. Thus, the vehicle lamp 10 fulfills the functions of tail and turn-signal lamps, as the lamp unit 12A is turned on in the stop lamp lighting mode while the lamp unit 12B maintains the turn-signal lamp lighting mode.

Figure 8:
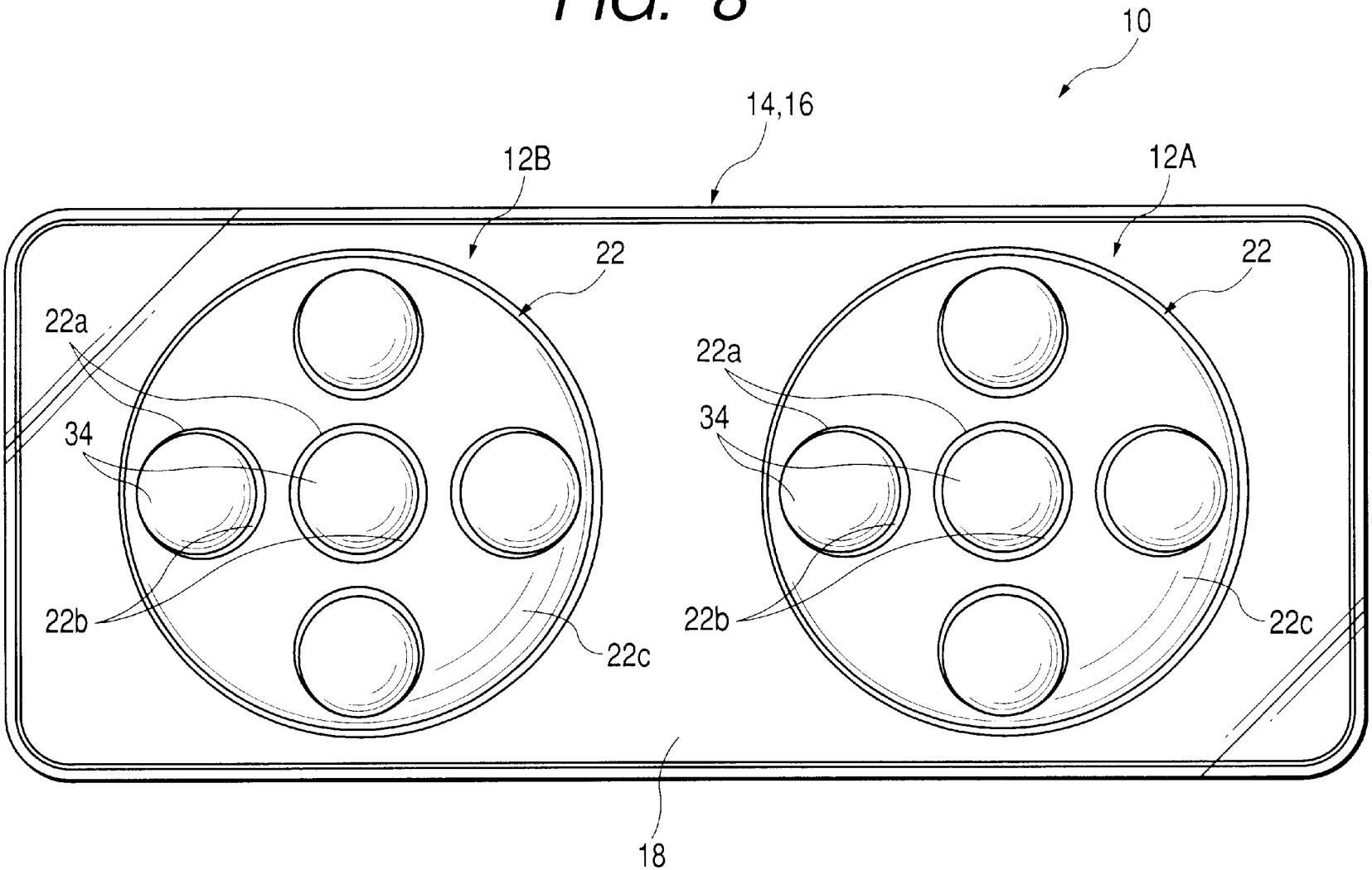
FIG. 8 is an elevation view of the vehicle lamp in the off state.

FIG. 8 is an elevation view showing the vehicle lamp 10 in the off state according to the embodiment of the present invention.

As shown in FIG. 8, each of the lamp units 12A and 12B in the off state looks luminous in a whitish fashion because of the external light reflective action of the half-mirror portion 22*c* of the translucent panel 22. Moreover, the surface of the condenser lens 34 positioned inside each of the five opening portions 22*a* formed crosswise appears to be slightly dark. Since the surface of the half-mirror portion 22*c* of the translucent panel 22 is dome-shaped, as is the surface of the condenser lens 34, five small cross-shaped translucent domes can be seen in the translucent panel 22 due to the reflection of external light. This provides a pleasingly integrated design. Since the surface of the cylindrical portion 22*b* of the translucent panel 22 of each of the lamp units 12A and 12B has also been subjected to the half-mirror processing, there is an emphasized contrast between the five condenser lenses 34 and their surrounding elements.

The vehicle lamp, according to the this embodiment of the present invention, is provided with a pair of lamp units 12A and 12B to be turned on in at least two lamp lighting modes that are different from each other. In addition, numerous other lamp lighting modes can be set, depending on the combination of lamp lighting modes. Moreover, since each of the lamp units 12A and 12B is provided with the nine light sources 20A (20B), a sufficient amount of light can be secured.

The dome-shaped translucent panel 22, as the half-mirror portion 22*c*, is provided in front of each of the light sources 20A and 20B. As the five opening portions 22*a* correspond to the five light sources 20A and 20B that are formed crosswise in the respective translucent panels 22, the following operational effect is achieved.

The interior of the vehicle lamp in the rear of the half-mirror portion 22*c* can be made invisible by the external light reflective action of the half-mirror portion. The interior of the vehicle lamp with respect to the five opening portions 22*a* can also be made visible while the vehicle lamp is in the off state. Therefore, unlike a conventional vehicle lamp that causes scenery ahead of the vehicle lamp to be simply reflected on the translucent cover in a whitish fashion, the interior of the vehicle lamp with respect to the five opening portions 22*a* is visible.

According to this embodiment of the present invention, since the condenser lens 34 is provided in the rear of each opening portion 22*a*, a lamp design in which a small translucent dome is disposed in a dome that appears to reflect external light is obtained. Thus, a feeling of design integration is provided for each of the lamp units 12A and 12B. Moreover, since the surface of the cylindrical portion 22*b* of the translucent panel 22 has been subjected to the half-mirror processing, emphasized contrast can be provided between the five condenser lenses 34 and their surroundings.

The condenser lens 34 appears to magnify each of the light sources 20A and 20B positioned in the rear of the condenser lens 34. However, the light sources 20A and 20B can be made less visible due to the diffusive action of the light passed through the diffusion lens 28 provided therebetween.

In addition, when the four light sources 20A and 20B positioned in the rear of the half-mirror portions 22*c* are turned on, each of the lamp units 12A and 12B appears to be luminous. The luminous intensity distribution is unexpected from the vehicle lamp design while the vehicle lamp is in the off state.

Specifically, as only the opening portion 22*a* in the interior of the vehicle lamp is visible while the vehicle lamp is in the off state, there is an appearance that only the opening portion 22*a* appears luminous, even while the vehicle lamp is in the on state. However, not only the opening portion 22*a* but also the half-mirror portion 22*c* actually looks luminous and this gives the luminous intensity distribution an unexpected nature.

Moreover, since the diffusion lens 28 is provided in front of each of the light sources 20A and 20B, the luminosity of the whole light source can be made to look substantially uniform over a wide luminescent area.

Further, due to the positioning of the four light sources amongst the light sources 20A and 20B positioned in the rear of the five opening portions 22*a*, the luminosity of the lamp units 12A and 12B, as a whole, can be made substantially uniform.

Thus, the appearance of the vehicle lamp is improved in any one of the cases where the vehicle lamp is in the on state and where the vehicle lamp is in the off state. This is achieved by making the appearance of the vehicle lamp in the on state different from the appearance of the vehicle lamp in the off state.

Since each of the light sources 20A of the lamp unit 12A is provided with nine LEDs 24R1 and 24R2, and since each of the light sources 20B of the lamp unit 12B is provided with nine LEDs 32R and 32U, each of the light sources 20A and 20B can be made to appear luminous over a wide luminescent area. In addition, the luminescent color of each of the light sources 20A and 20B can properly and readily be selected.

Even in the case where a portion of the translucent panel 22 is formed of the non-half-mirror portion or the opening portion that is not subjected to the half-mirror processing, the same operational effect as that in this embodiment thereof is also achievable. At this time, it is acceptable to properly form lens elements in the non-half-mirror portion or the opening portion and in this case, a new vehicle lamp design would be created.

Although a description has been given of a case where the vehicle lamp 10 is a rear combination lamp comprising a lamp unit 12A that is turned on in the tail lamp lighting mode and the stop lamp lighting mode, and a lamp unit 12B that is turned on in the tail lamp lighting mode and the turn-signal lamp lighting mode, the same operational effect can be achievable by applying the concepts described in the above-described embodiment thereof to any other kind of vehicle lamp.

The foregoing description of an embodiment of the present invention has been presented for purposes of illustration and description. It is not intended to be exhaustive or to limit the present invention to the precise form disclosed, and modifications and variations are possible in light of the above teachings or may be acquired from practice of the present invention. The embodiment was chosen and described in order to explain the principles of the present invention and its practical application to enable one skilled in the art to utilize the present invention in various embodiments and with various modifications as are suited to the particular use contemplated.

What is claimed is:

1. A vehicle lamp comprising a light source and a translucent panel provided in front of said light source, wherein:

said translucent panel comprises half-mirror portions subjected to half-mirror processing and non-half-mirror portions or opening portions; and a plurality of light sources are provided so that said light sources are positioned to the rear of said half-mirror portions and said non-half-mirror portions or said opening portions said vehicle lamp further comprising a plurality of condenser lenses provided between said non-half-mirror portions or said opening portions and said plurality of light sources positioned to the rear of said non-half-mirror portions or said opening portions.

2. The vehicle lamp as claimed in claim 1, wherein said translucent panel is dome-shaped.

3. The vehicle lamp as claimed in claim 1, wherein a diffusion lens is provided between said plurality of condenser lenses and said plurality of light sources.

4. The vehicle lamp as claimed in claim 2, wherein said non-half-mirror portions or said opening portions are provided in the central position of said translucent panel and in a plurality of positions peripherally surrounding said central position.

5. The vehicle lamp as claimed in claim 1, wherein said non-half-mirror portions or said opening portions are provided in the central position of said translucent panel and in a plurality of positions peripherally surrounding said central position.

6. The vehicle lamp as claimed in claim 4, wherein said light sources positioned to the rear of said half-mirror portions are disposed between adjacent said light sources positioned to the rear of said non-half-mirror portions or said opening portions.

7. The vehicle lamp as claimed in claim 1, wherein each of said light sources comprises a plurality of LEDs.

8. The vehicle lamp as claimed in claim 3, wherein said diffusion lens comprises a plurality of fish-eye lenses.

9. A vehicle lamp as claimed in claim 3, wherein each of said plurality of condenser lenses is a planoconvex lens having a convex surface on a side facing away from said diffusion lens.

* * * * *